US007560913B2

(12) United States Patent
Petrowsky et al.

(10) Patent No.: US 7,560,913 B2
(45) Date of Patent: Jul. 14, 2009

(54) INPUT-TRACKING, AUTOMATIC OUTPUT-MARGINING METHOD AND SYSTEM

(75) Inventors: William J. Petrowsky, Kingston, NY (US); Brian C. Tucker, Hyde Park, NY (US)

(73) Assignee: International Business Machines Corporation, Armonk, NY (US)

( * ) Notice: Subject to any disclaimer, the term of this patent is extended or adjusted under 35 U.S.C. 154(b) by 247 days.

(21) Appl. No.: 11/534,358

(22) Filed: Sep. 22, 2006

(65) Prior Publication Data

US 2008/0074091 A1 Mar. 27, 2008

(51) Int. Cl.
*G05F 1/577* (2006.01)

(52) U.S. Cl. ..... 323/266; 323/267; 323/270

(58) Field of Classification Search ..... 323/266, 323/267, 270

See application file for complete search history.

(56) References Cited

U.S. PATENT DOCUMENTS 3,725,740 A 4/1973 Kuster
4,677,566 A 6/1987 Whittaker et al.
6,218,821 B1 4/2001 Bisbee
6,316,988 B1 11/2001 Forehand et al.
6,697,952 B1 2/2004 King
6,774,612 B1 8/2004 Ballenger et al.
6,839,782 B1 1/2005 Scaringella et al.
7,023,187 B2 * 4/2006 Shearon et al. ..... 323/266
7,274,175 B2 * 9/2007 Manolescu ..... 323/267
2004/0039536 A1 2/2004 Garnett

* cited by examiner

*Primary Examiner*—Jeffrey L Sterrett
(74) *Attorney, Agent, or Firm*—Cantor Colburn LLP; Gerry Monteleone

(57) ABSTRACT

An input-tracking and automatic output-margining system and method including: a logic board having a first load, a second load, and a first regulator disposed thereon; and a power supply having a bulk power source, a precision reference voltage, and a second regulator disposed therein; the first load supplied by a first voltage generated by the power supply, and the second load supplied by a second voltage generated by the first regulator; wherein a reference input to the first regulator comprises a first feedback voltage derived from the first voltage, such that a change in the value of the first voltage is tracked by the second voltage.

26 Claims, 2 Drawing Sheets

INPUT-TRACKING, AUTOMATIC OUTPUT-MARGINING METHOD AND SYSTEM

BACKGROUND

1. Field of the Invention

The present invention generally relates to regulators, and more specifically, to an input-tracking, automatic output-margining method and system. The present invention describes a method and system for controlling voltage margining of a small regulator located on a logic circuit in communication with an external power supply.

2. Description of Background

During manufacturing test routines, computer logic is often run for sustained periods at voltages higher or lower than the nominal. This is done to ensure the robustness of the product, and the procedure is referred to as margining. For most high-current power supply outputs, the voltage is adjusted dynamically through the use of a DAC (digital-to-analog converter) affecting the regulator's precision voltage reference. This DAC is controlled by a microprocessor internal to the power supply, and is issued instructions from an outside source.

On occasion, small regulators may be located on a system logic board, as opposed to within the power supply itself. These small regulators often have limited features, and it may not be possible to have computer control over voltage margining. Traditionally, two methods have been used to control voltage margining on small on-board regulators.

In a first method, an Intel VRM (Voltage Regulator Module) compliant regulator controller is used. These chipsets include a VID (Voltage ID) feature, which is a series of logic-level inputs that act as a DAC input and allow output voltage to be dynamically adjusted according to the applied bit pattern. This topology requires a digital interface to the regulator, which may not be easily available on a logic board external to the power supply. Additionally, margining capability is limited to the discrete voltage step sizes, which are determined by the chipset manufacturer.

In a second method, an external reference may be supplied on small linear or switch-mode regulators. Several resistor dividers may be used to combine an external margining circuit with the external precision reference, allowing for small voltage changes. Often times, the circuit is simply a MOSFET (Metal Oxide Semiconductor Field Effect Transistor) with a series resistor that toggles a margin state either on or off (e.g., allowing a +/−7% change in output voltage) but does not allow fine resolution adjustability. This method is easier to interface to than the first method, and can offer more control over the maximum margin sizes, but does not have much flexibility.

Accordingly, it is desirable to implement a method that allows extensive margining capabilities, allows more granularity within voltage margining capabilities, and improves output voltage accuracy.

SUMMARY

One aspect of the invention is a logic circuit comprising: a first load and a second load; and a first regulator for converting a first voltage to a second voltage; wherein the regulator receives the first voltage that tracks an internal reference voltage of an external power supply having a second regulator.

Another aspect of the invention is an input-tracking and automatic output-margining system, the system comprising: a logic board having a first load, a second load, and a first regulator; and a power supply having a bulk power source, a precision reference voltage, and a second regulator; wherein the second regulator receives the precision reference voltage, the precision reference voltage being adjusted to vary a voltage of the second regulator.

Another aspect of the invention is a method for implementing input-tracking and automatic output-margining of a locally disposed voltage regulator on a logic board, the method comprising: receiving a first, externally generated voltage to supply a first load within the board; utilizing the first voltage as an input power source for the locally disposed generator to generate a second voltage to supply a second load within the board; and utilizing a first feedback voltage derived from the first voltage as a reference input to the local voltage regulator, wherein a change in the value of the first voltage is tracked by the second voltage.

BRIEF DESCRIPTION OF THE DRAWINGS

Referring to the exemplary drawings wherein like elements are numbered alike in the several Figures.

DETAILED DESCRIPTION

Figure 1:
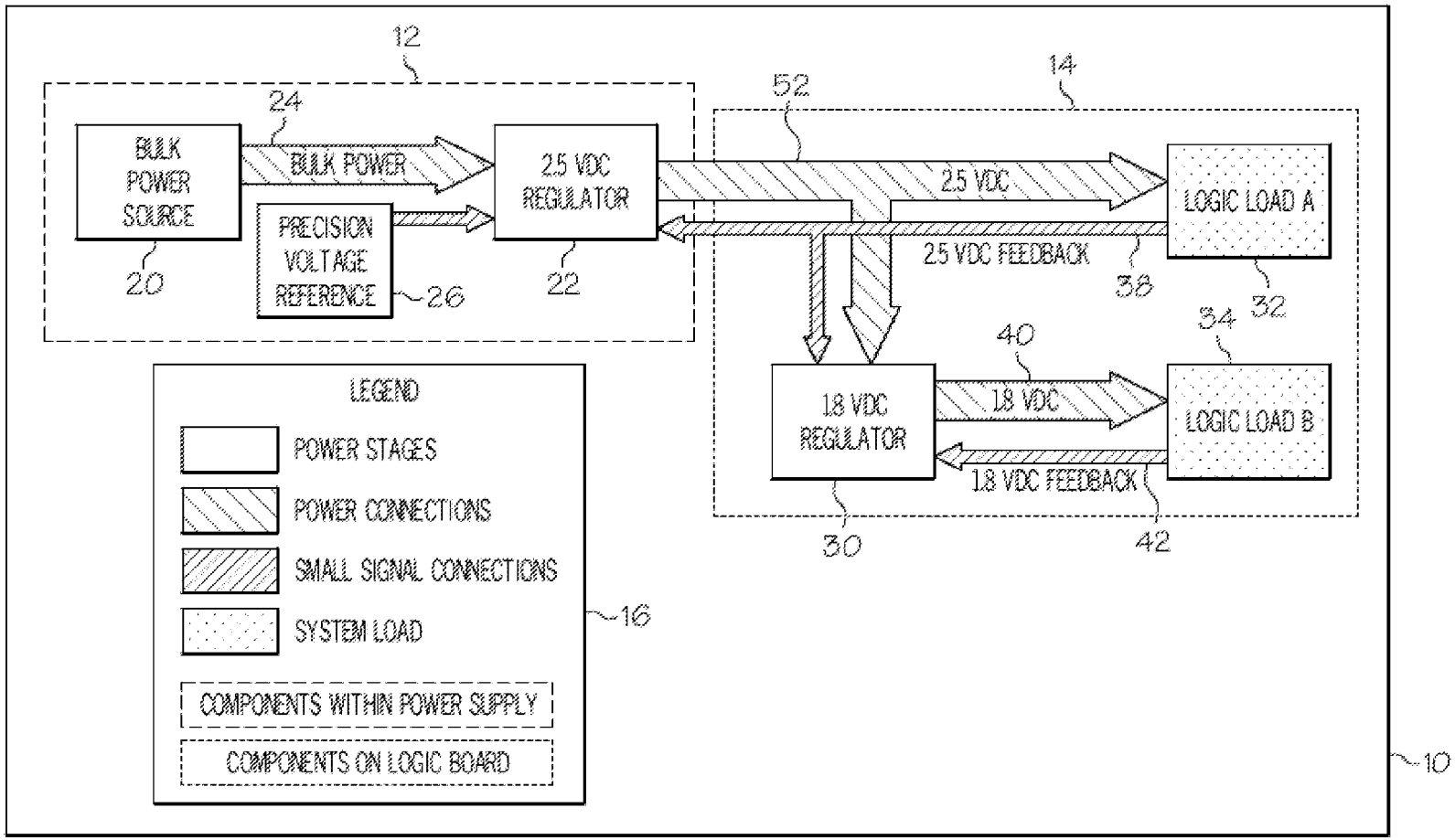
FIG. 1 illustrates a block diagram of an input-tracking, automatic output-margining system according to the exemplary embodiments of the present invention.

One aspect of the exemplary embodiments is improving output voltage accuracy. Another aspect of the exemplary embodiments is eliminating the need for a potentially expensive external reference supplied on small linear or switch-mode regulators. In yet another exemplary embodiment, allowing for more granularity within voltage margining capabilities is presented.

The exemplary embodiments of the present invention permit a power supply's margining capabilities to be accurate and flexible by allowing a reference input to a regulator located on a logic board to have a first feedback voltage derived from a voltage supplied by an external power supply, such that a change in the value of the supplied voltage is tracked by an output voltage measured on the regulator located on the logic board.

In general, a power supply can have one or more output voltages feeding a logic board. In high-performance systems, the power supply has connections to the logic board, typically near a processor or other heavy load. The power supply as well as the circuit board each may include a separate regulator. The power supply regulator may feed a first load on the logic board and the logic board regulator may feed a second load on the logic board. A reference input to the logic board regulator may include a feedback voltage derived from a voltage supplied from the power supply to the logic board, such that a change in the value of the supplied voltage is tracked by a second voltage sensed on the logic board regulator located on the logic board. Therefore, the power supply ensures that the voltage sensed on the small regulator located on the logic board exactly matches the voltage of the power supply's internal precision voltage reference. As a result, if changes are made to the precision reference voltage of the power supply, as would be done for margining, the small regulator of the logic circuit changes its output voltage accordingly, effectively tracking the margined voltage level.

A small regulator located on the logic board uses the precision voltage reference that supplies voltage to the power supply regulator as a reference for voltage adjustment. A small regulator is basically a Point-of-load ("POL") regulator, which is also referred to as a voltage regulator or a DC/DC converter, and is commonly used in conjunction with electronic circuits. This is because the voltage/current requirements of electronic circuits typically differ from the voltage that is readily available or the current that can practically be delivered. For example, some electronic devices only include a single voltage input but require different voltages for circuits contained within the electronic devices. Traditionally, POL regulators operate in conjunction with a power supply controller that activates, programs, and monitors the POL regulators. In one exemplary embodiment, the POL has low-power capability, configured to receive an input voltage of less than 3V and an output current of less than about 10 A.

Referring to FIG. 1, a block diagram of an input tracking, automatic output-margining system 10 is illustrated. The system 10 includes a power supply 12 and a logic board 14. The power supply 12 includes a bulk power source 20, a 2.5 VDC regulator 22, a bulk power input 24 from the bulk power source 20 to the 2.5 VDC regulator 22, and a precision voltage reference 26 input to the 2.5 VDC regulator 22. The logic board 14 includes a 1.8 VDC regulator 30, a first logic load 32 (Logic Load A), a second logic load 34 (Logic Load B), a 2.5 VDC input 52 from the 2.5 VDC regulator 22 to the first logic load 32, a 2.5 VDC feedback output 38 from the first logic load 32 to the 2.5 VDC regulator 22, a 1.8 VDC output 40 from the 1.8 VDC regulator 30 to the second logic load 34, and a 1.8 VDC feedback output 42 from the second logic load 34 to the 1.8 VDC regulator 30.

As illustrated in FIG. 1, the 2.5 VDC regulator 22 is used to power the first logic load 32, as well as to supply bulk power to the 1.8 VDC regulator 30. The 2.5 VDC feedback output 38 is used as a regulation feedback loop for the 2.5 VDC regulator 22, as well as being a precision reference for the 1.8 VDC regulator 30. In addition, the 2.5 VDC output 38 is scaled down by the regulator 30 to a more applicable voltage for the second logic load 34 (e.g., 1.8 VDC).

Figure 2:
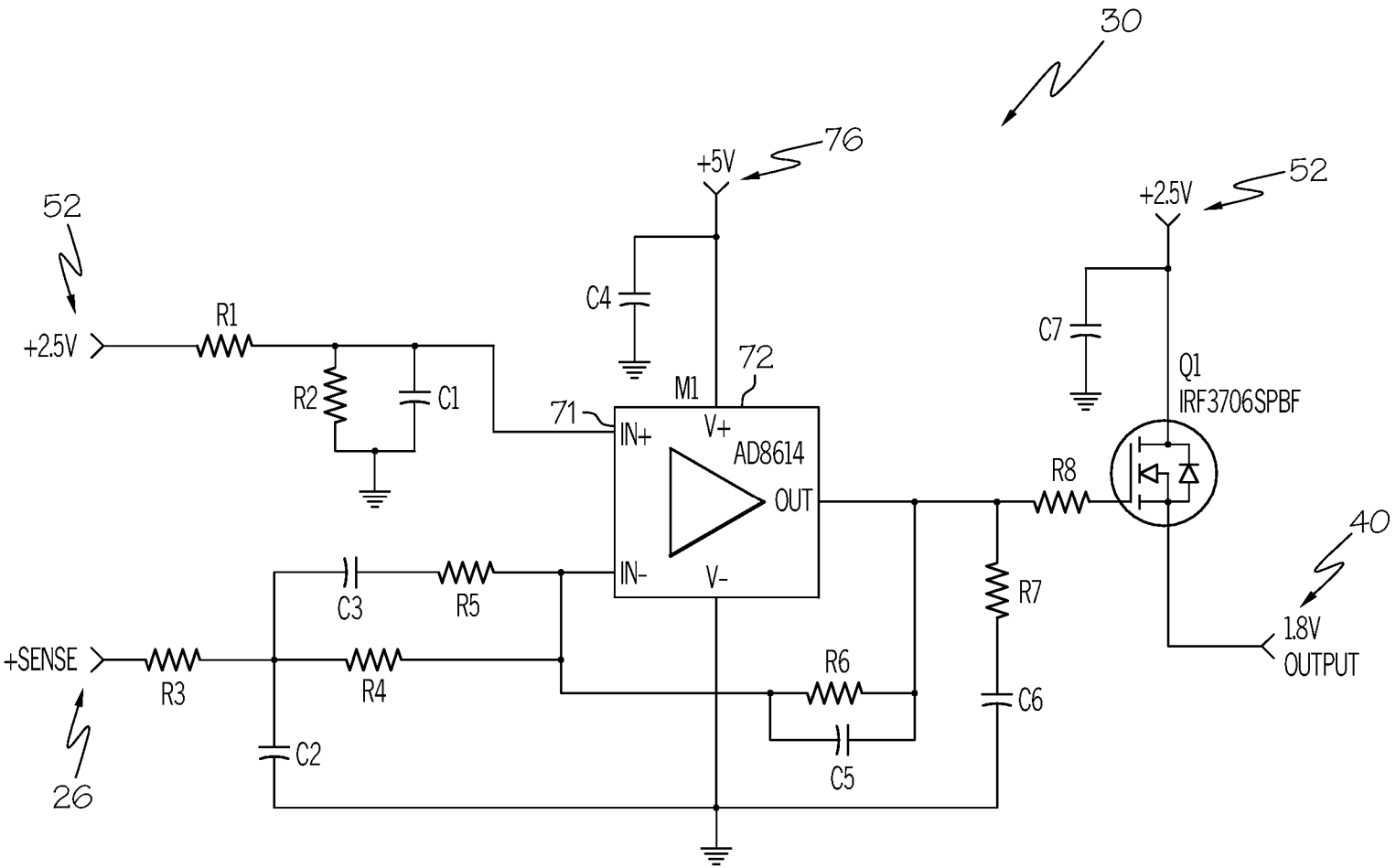
FIG. 2 illustrates a circuit diagram of an input-tracking, automatic output-margining system according to the exemplary embodiments of the present invention.

Referring to FIG. 2, a circuit diagram of an input tracking, automatic output-margining system is illustrated. The circuit diagram of FIG. 2 is one exemplary circuit diagram that may be used to represent the 1.8 VDC regulator 30 of FIG. 1. The regulator circuit 30 includes two inputs, a 2.5 V input 52, which is the input power from 2.5 VDC regulator and a sense input 26, which is the precision voltage reference.

The 2.5 V input 52 is connected to a resistor R1, which is further connected to a circuit topology including a resistor R2 in parallel with a capacitor C1. This three-component circuit configuration is connected to the positive input of an operation amplifier 72.

The sense input 26 is connected to a resistor R3, which is connected to a circuit topology including a capacitor C3 in series with a resistor R5, both capacitor C3 and resistor R5 in parallel with a resistor R4. In addition, resistor R3 is connected to a capacitor C2, which is further connected to ground. Resistor R4 is connected to a circuit topology including a resistor R6 in parallel with a capacitor C5. Resistor R7 is connected is series with capacitor C6, which is further connected to ground. This circuit configuration, including the elements resistor R3, capacitor C3, resistor R5, resistor R4, capacitor C2, resistor R6, capacitor C5, capacitor C6, and resistor R7, is connected to the negative input of the operational amplifier 72. The positive power supply voltage of the operational amplifier 72 is connected to a capacitor C4 and a 5V node 76. The negative power supply voltage of the operational amplifier 72 is connected to ground.

The output of the operational amplifier 72 provides feedback to the negative input of the operational amplifier 72 via the resistor R6, which is in parallel with the capacitor C5. The output of the operational amplifier 72 is further connected to a resistor R8, which is connected to a transistor Q1. The input of the transistor Q1 is connected to a capacitor C7 and a 2.5 V node 52. The output of the transistor Q1 is connected to a 1.8 V node 40.

In operation of the circuit 30, the operational amplifier 72 establishes a reference comparison in order to regulate the output voltage 40. In addition, the operational amplifier 72 is configured to reduce the error between the output voltage 40 and the positive input voltage 71 to a value of zero. Also, the output voltage 40 is read by the sense input 26. This operation is performed in order to ensure that the system is stable and in order to avoid oscillation. In order to reduce the error between the output voltage 40 and the positive input voltage 71 to a value of zero, the transistor Q1 is fed via the resistor R8 in order to drive the transistor Q1 as hard as desired. The amplifier 72 attempts to force the correct output voltage 40 by providing various levels of power to the transistor Q1. Thus, the transistor Q1 acts as a variable resistor. In addition, the conductance is varied between the voltage output 40 and the 2.5V node 52 in order to accommodate for the varied levels of power required by the load connected to 40. In FIG. 2, the 1.8 V output is connected to the logic, which it powers. The +sense input 26 is also connected to the logic at the point we want to regulate the voltage. The feedback is applied from that point to the +sense input 26. This driving process provides for voltage-margining capabilities that are derived from a power supply that is of very high precision, where the regulator is forced to track its input.

The reference input to the logic circuit regulator includes a feedback voltage derived from a voltage supplied by the power supply, such that the change in the value of the precision voltage reference supplied to the power supply regulator is tracked by the measured voltage on the small regulator located on the logic circuit. The voltage measured on the small regulator on the logic circuit is as accurate as the precision voltage reference feeding the power supply regulator, which has a high degree of margining capability. Consequently, the small regulator on the logic circuit has an accurate voltage reference (typically more accurate than that supplied with small regulators) and margining capability that requires no external connections. Ordinarily margining requires separate inputs that control the regulator from a microprocessor or logical switch. These external connections to the 1.8V regulator are not needed when the exemplary embodiments of the present invention are employed because it inherently tracks margining applied to the 2.5V input. Note that a 1% shift in the 2.5V regulator output produces a 1% shift in the 1.8V output.

Essentially, by connecting the small, on-board regulator in this fashion, the small regulator can have similar voltage accuracy and margining capabilities as the main power supply regulators, while reducing overall circuit cost and complexity. The benefit of tracking the precision voltage reference supplied to the power supply regulator by the measured voltage on the small regulator located on the logic circuit is to accurately use the output voltage of the small regulator as a reference to an internal voltage of a power supply in order to control one or more loads located on the logic circuit.

While the invention has been described with reference to a preferred embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A logic board comprising:

a first load supplied by a first voltage generated externally with respect to the board;

a second load supplied by a second voltage generated within a local voltage regulator;

the local voltage regulator configured to generate the second voltage using the first voltage as an input power source thereto, the local voltage regulator comprising an operational amplifier and a variable resistance; and wherein a reference input to a first input terminal of the operational amplifier of the local voltage regulator comprises a first feedback voltage derived from the first voltage and the variable resistance receives an output of the operational amplifier to generate the second voltage, such that a change in the value of the first voltage is tracked by the second voltage.

2. The logic board of claim 1, wherein the first load provides the first feedback voltage to an external power supply that generates the first voltage.

3. The logic circuit of claim 2, wherein the second load provides a second feedback voltage to a second input terminal of the operational amplifier of the local regulator.

4. The logic circuit of claim 1, wherein the variable resistance receives the first feedback voltage.

5. The logic circuit of claim 1, wherein the first voltage is about 2.5 Volts and the second voltage is about 1.8 Volts.

6. The logic circuit of claim 1, wherein the variable resistance is a transistor with a first input connected to the output of the operational amplifier and a second input connected to the first feedback voltage.

7. The logic circuit of claim 1 wherein the first feedback voltage is about 2.5 Volts and the second feedback voltage is about 1.8 Volts.

8. The logic circuit of claim 1, wherein the local regulator is configured to receive an input voltage of less than 3 Volts and a current of less than about 10 Amps.

9. An input-tracking and automatic output-margining system, the system comprising:

a logic board having a first load, a second load, and a first regulator disposed thereon including an operational amplifier and a variable resistance; and a power supply external with respect to the logic board having a bulk power source, a precision reference voltage, and a second regulator disposed therein;

the first load supplied by a first voltage generated by the power supply, and the second load supplied by a second voltage generated by the first regulator;

wherein a reference input to a first input terminal of the operational amplifier of the first regulator comprises a first feedback voltage derived from the first voltage, an output of the operational amplifier being connected to the variable resistance that generates the second voltage such that a change in the value of the first voltage is tracked by the second voltage.

10. The system of claim 9, wherein the bulk power source delivers bulk power to the second regulator.

11. The system of claim 9, wherein the first load provides the first feedback voltage to the second regulator associated with the power supply.

12. The system of claim 9, wherein the first regulator receives the first voltage as an input power source thereto.

13. The system of claim 9, wherein the variable resistance is connected to the first feedback voltage.

14. The system of claim 9, wherein the first voltage is about 2.5 Volts and the first feedback voltage is about 2.5 Volts.

15. The system of claim 9, wherein the second load provides a second feedback voltage to a second input terminal of the operational amplifier of the first regulator.

16. The system of claim 15, wherein the second voltage is about 1.8 Volts and the second feedback voltage is about 1.8 Volts.

17. The system of claim 9, wherein the variable resistance is a transistor connected to the first feedback voltage and to the output of the operational amplifier to produce the second voltage.

18. The system of claim 9, wherein the local regulator is configured to receive an input a voltage of less than 3 Volts and a current of less than about 10 Amps.

19. A method for implementing input-tracking and automatic output-margining of a locally disposed voltage regulator on a logic board, the method comprising:

receiving a first, externally generated voltage to supply a first load within the board;

utilizing the first voltage as an input power source for the locally disposed generator to generate a second voltage to supply a second load within the board; and utilizing a first feedback voltage derived from the first voltage as a reference input to a first input terminal of an operational amplifier of the local voltage regulator, wherein a variable resistance of the local voltage regulator is connected to an output terminal of the operational amplifier such that a change in the value of the first voltage is tracked by the second voltage.

20. The method of claim 19, wherein the first load provides the first feedback voltage to an external power supply that generates the first voltage.

21. The method of claim 20, wherein the second load provides a second feedback voltage to a second input terminal of the operational amplifier of the local regulator.

22. The method of claim 19, wherein an input of the variable resistance is connected to the first feedback voltage.

23. The method of claim 19, wherein the first voltage is about 2.5 Volts and the second voltage is about 1.8 Volts.

24. The method of claim 19, wherein the variable resistance is a transistor with a first input connected to the output of the operational amplifier and a second input connected to the first feedback voltage to produce the second voltage as an output of the transistor.

25. The method of claim 19, wherein the first feedback voltage is about 2.5 Volts and the second feedback voltage is about 1.8 Volts.

26. The method of claim 19, wherein the local regulator is configured to receive an input voltage of less than 3Volts and a current of less than about 10 Amps.

* * * * *